United States Patent [19]

Atkinson

[11] Patent Number: 4,988,009

[45] Date of Patent: Jan. 29, 1991

[54] TELESCOPIC BOOM MOBILE CRANES

[75] Inventor: John Atkinson, Riding Mill, England

[73] Assignee: Grove Coles Limited, England

[21] Appl. No.: 349,613

[22] Filed: May 10, 1989

[30] Foreign Application Priority Data

May 12, 1988 [GB] United Kingdom ..... 8811230

[51] Int. Cl.[5] ..... B66C 23/26

[52] U.S. Cl. ..... 212/182; 212/185; 212/187; 212/231; 212/264

[58] Field of Search ..... 212/175, 182, 181, 180, 212/187, 230, 264, 185, 238, 231, 261; 182/2; 52/119

[56] References Cited

U.S. PATENT DOCUMENTS

| | | | |
|---|---|---|---|
| 3,768,665 | 10/1973 | Eiler et al. | 212/197 |
| 3,987,594 | 10/1976 | Rao et al. | 212/187 |
| 4,047,618 | 9/1977 | Kuester | 212/187 |
| 4,091,935 | 5/1978 | Whittingham | 212/181 |

FOREIGN PATENT DOCUMENTS

| | | | |
|---|---|---|---|
| 1261992 | 2/1968 | Fed. Rep. of Germany | 212/230 |
| 2450003 | 5/1976 | Fed. Rep. of Germany | 212/175 |
| 224301 | 7/1985 | German Democratic Rep. | 212/264 |
| 477934 | 12/1975 | U.S.S.R. | 212/182 |
| 676541 | 7/1979 | U.S.S.R. | 212/175 |

*Primary Examiner*—Sherman Basinger
*Assistant Examiner*—Thomas J. Brahan
*Attorney, Agent, or Firm*—Townsend and Townsend

[57] ABSTRACT

A telescopic boom mobile crane wherein the boom may be disconnected from the turntable characterized in that the crane vehicle has rollers (or their equivalent) to support the collapsed boom on the vehicle while permitting the boom longitudinally to move along the vehicle, releasable means being provided pivotally to connect the base of the boom to the vehicle and drive means being provided to move the boom longitudinally relative to the vehicle. This enables a boom of longer length that hitherto to be stowable on the crane vehicle itself for transportation.

8 Claims, 3 Drawing Sheets

TELESCOPIC BOOM MOBILE CRANES

Figure 1:
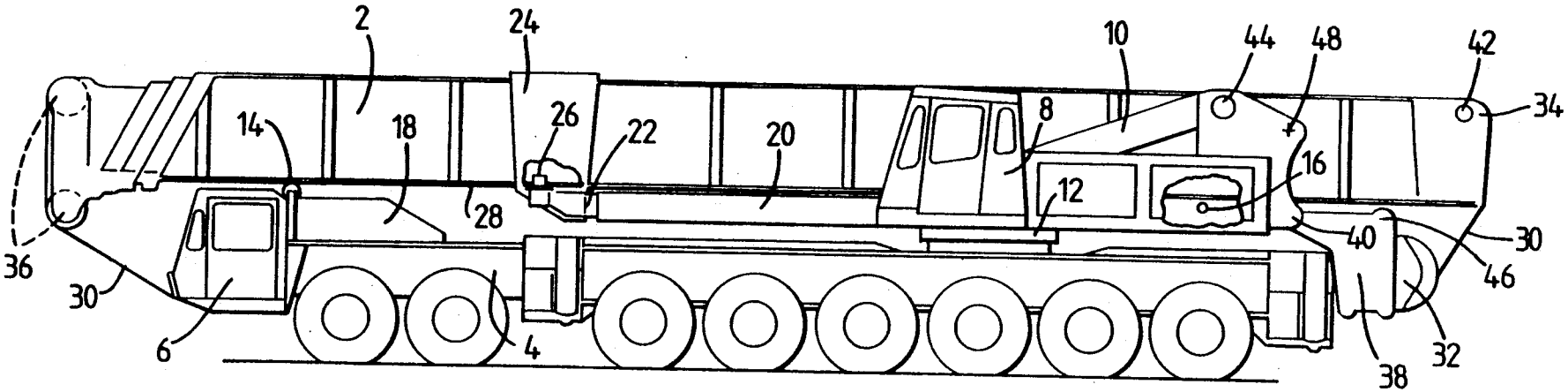

This invention relates to telescopic boom mobile cranes.

For a mobile telescopic crane to be roadworthy it must be designed within the restraints imposed by the legislation of the specific countries in which the crane is to be used.

The parameters to which legislation is applied are:

(a) The axle loading of the vehicle.
(b) Overall height.
(c) Turning circles—both the extreme outside radius and inner radius.
(d) Overall length.
(e) Overhang i.e. the extent to which the parts of the rotating crane extend beyond the extreme points of the carrier vehicle.
(f) Overall width.

Whereas there is variation between different countries on the exact values placed on these parameters there is broad agreement in the major countries where these cranes are used.

The parameters take no account of the lifting capacity. Lifting capacity is expressed in terms of not only the maximum load which can be lifted but also the height and reach which can be achieved of the crane being transported and therefore the objective of this invention is to produce a mobile crane having the optimum performance within these restraints.

For lifting capacity the boom length is one of the most important criteria and it is desirable to increase this beyond the currently available designs whilst maintaining compliance with legislation.

In existing proposals, in order to increase the boom length beyond that achievable within the regulations governing the permissible overlap of the front of the boom beyond the front of the vehicle, the boom has been made detachable and is transported separately. This greatly increases operating costs of the crane due to the need to provision extra transport and in the time taken to re-mount the boom to bring the crane into working order.

A telescopic boom mobile crane in accordance with this invention has rollers (or their equivalent) to support the collapsed boom on the vehicle whilst permitting the boom to be moved longitudinally along the vehicle, releasable means being provided pivotally to connect the base of the boom to the vehicle and drive means being provided to move the boom longitudinally relative to the vehicle.

Thus after lowering the boom to a horizontal position on the vehicle, the base of the boom may be disconnected from the turntable and the boom moved to a position such that its base projects an acceptable distance beyond the end of the carrier vehicle. If the front end of the collapsed boom then projects forwardly beyond the end of the carrier only by an acceptable distance, the maximum length of boom can be utilised for that particular carrier vehicle.

Preferably the means to move the boom relatively to the carrier comprises the main hydraulic boom lifting cylinder used to elevate the boom. This may be achieved by releasably connecting the end of the piston to the main lifting cylinder to one of a series of positions along the boom length. If the position nearest the outer end of the boom is first chosen the boom may be moved forwardly relatively to the carrier vehicle by a distance equivalent to the stroke of the piston, the piston is then disconnected from the boom and retracted and thereafter reconnected to the boom at the next position towards the boom base. The operation is repeated until the boom reaches the position in which its rear end may be connected to a turntable on the vehicle whereafter the main hydraulic cylinder operates to pivot the boom upwardly above its pivot.

To stow the boom this is first lowered to a horizontal position and in which it rests on rollers on the vehicle. The connection between the base of the boom and the turntable on the carrier is first disconnected. The piston is then disconnected from its position nearest to the base of the boom, extended and then connected to the next position along the boom towards its outer end. On subsequent retraction, the boom is movable rearwardly by a distance equivalent to the stroke of the piston in its cylinder. This step is repeated until the boom has reached its travelling position at which it overlaps the carrier vehicle by an acceptable distance both at the front and rear of the carrier.

When the boom is finally positioned on the vehicle ready for travel its final position may be finely adjusted relative to the vehicle by movement of the piston, to help to equalise the axle loads and to optimise these up to the maximum allowable on all axles.

Preferably the hoist drum by means of which the hoist rope is driven to lift a load to be carried by the crane, is mounted on a unit pivotally mounted to the vehicle so that it may be moved, when not in use, to a position in which the rear end of the boom may be slid beyond the end of the frame of the carrier vehicle.

The invention will now be further described by way of example with reference to the accompanying drawings in which:

FIG. 1 is an elevation of a telescopic boom mobile crane of the invention with the boom positioned on the vehicle ready for travel, and FIGS. 2 to 5 are views similar to FIG. 1 but showing the boom progressively being moved on the carrier to a position in which it is ready for use.

Referring to FIG. 1 the telescopic crane boom generally illustrated at 2 is shown mounted in a horizontal position on a carrier vehicle generally illustrated at 4 having a multitude of axles, the axle suspension being such as to share the load applied between the axles so that the load is distributed in an ideal manner on the vehicle and equalisation of the load taken by all axles is achieved.

Telescopic outriggers (not shown) would normally be supplied to provide the required stability when the boom is erect and carrying loads in the normal manner.

The vehicle is driven on the roads by a driver within the vehicle cab 6 but when the crane is being operated the operator is in a further cab 8 carried by a superstructure frame 10 mounted on the chassis 4 of the vehicle through a turntable 12.

The main boom 2 comprises telescopic boom sections, hydraulic means being provided to extend the various telescopic sections one from another so as to elongate the boom when this is in an erected position ready for use. The boom as shown in the drawing, is in the retracted position and of minimum length.

As shown in FIG. 1 the boom is resting on rollers 14 and 16, the roller 14 being carried by a frame 18 mounted on the main frame 4 of the carrier and the rollers 16 being carried by the frame of the super-structure 10. These rollers enable the boom to be moved longitudinally relatively to the carrier when the boom is in its horizontal position resting on the rollers.

The main boom lifting piston and cylinder 20 is pivotally mounted at its inner end to the frame of the superstructure 10 and the end of the piston 22 of the piston/-cylinder combination 20 is pivotally mounted to a bracket 24 which surrounds at least part of the boom and which carries a pin 26 which is electrically or hydraulically operable to engage in one of a series of holes provided at spaced positions in the underside boom structure members or plates 28.

The main hoist rope 30 which extends from a hoist drum 32 at the rear end of the carrier extends around rollers 34 at the base of the boom to rollers 36 at the head of the boom. During travel its outer free end is secured to the carrier.

The hoist drum 32 is mounted on a bracket 38 which is pivotally mounted at 40 to the rear of the super-structure frame 10. As shown in FIG. 1 the bracket 38 is pivotted downwardly behind the rear end of the carrier vehicle to permit the boom to extend rearwardly beyond the rear end of the carrier over the downwardly pivotted hoisting drum bracket 38.

When the crane arrives on site in the configuration shown in FIG. 1 it has to be put in a condition ready for use. FIGS. 2 to 5 illustrate this operation in sequence.

Figure 2:
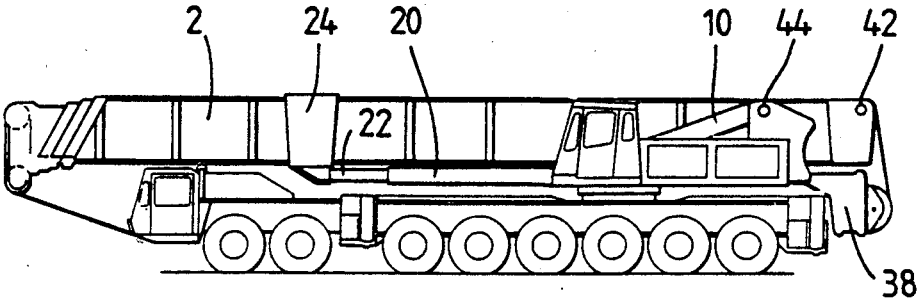

First of all the piston 22 of the piston/cylinder 20 is extended from the position shown in FIG. 1 to that shown in FIG. 2. As the pin 26 is engaged with the boom this means that the boom is moved longitudinally forwardly over the rollers 14/16 relatively to the carrier vehicle.

Figure 3:
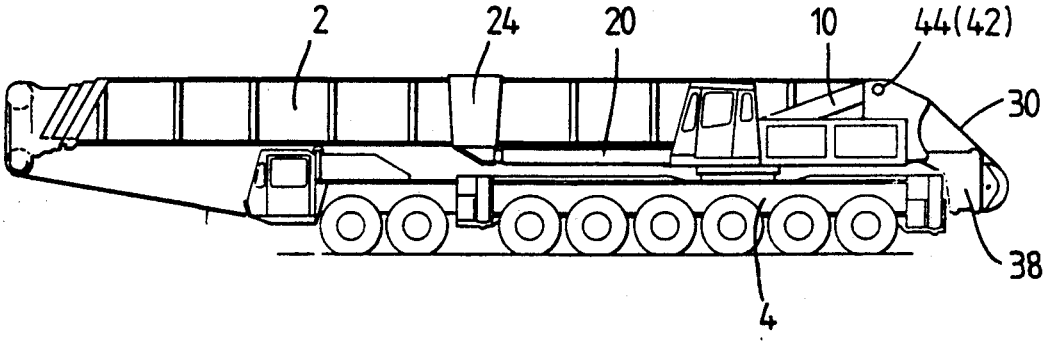

The pin 26 is then disconnected from the boom and the piston 22 retracted moving the bracket 24 backwardly along the boom to a new position. The pin 26 is then again engaged within the boom at the next hole towards the base of the boom and the boom is then again moved forwardly by a distance equivalent to the stroke of the piston 22 in its cylinder. This operation is repeated until the pivot point 42 at the base of the boom is aligned with the main pivot point 44 on the superstructure frame as can be seen in FIG. 3. Powered boom pivot pins can then be engaged so as firmly to pivotally connect the base boom with the super-structure.

Figure 4:
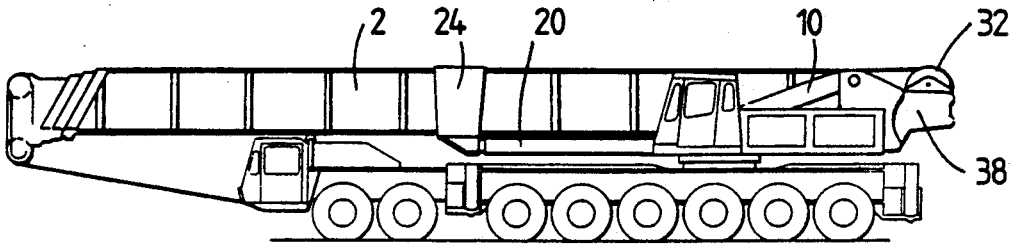

The bracket 38 carrying the main hoisting drum 32 can then be pivotted upwardly to the position shown in FIG. 4 at which the eye 46 on the bracket is aligned with an eye 48 on the super-structure frame, the upper locating pins then being engaged firmly to secure the hoisting drum in its correct position as illustrated in FIG. 4. This operation can be carried out by hoisting on the hoist rope or alternatively separate pivot means may be provided.

In this position the pin 26 at the end of the main piston 22 is secured in the hole in the boom nearest the base of the boom (see FIGS. 3 to 5) so that the boom may thereafter be elevated by pivotal movement about the main pivot point 34 by further extension of the main piston 22.

Figure 5:
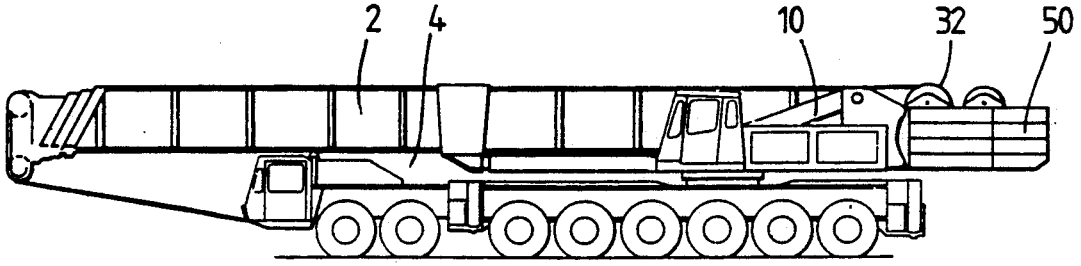

Any desired counterweights 50 (see FIG. 5) can then be attached to the rear of the super-structure as illustrated in FIG. 5.

After use the boom is lowered to a horizontal position on the carrier (i.e. to the position shown in FIG. 5) and the connection between the boom and the pins connecting the boom to the super-structure (42/44) removed. The pin 26 is disconnected from the boom and the piston extended beneath the boom until the next outermost hole is reached. The pin is then re-inserted to connect the piston in its extended position to the boom and the piston retracted to move the boom rearwardly. This operation is again repeated in reverse order to that illustrated in FIGS. 2 to 5 with the boom sliding rearwardly along the rollers until the position shown in FIG. 1 is again reached.

As a final operation the boom position may be finally adjusted on the carrier by use of the piston 22 to equalise the axle loads along the length of the vehicle.

The main advantage of a crane in accordance with the invention is that the boom may have a length which is only limited by the overall length of the carrier vehicle. This enables the complete working crane to be available on one vehicle with no requirement for additional support vehicles and with an optimised length of boom within the legislation restraints concerning the turning circle and front and rear overhang.

What I claim is:

1. A telescopic boom mobile crane, comprising:

a vehicle;

a turntable, rotably mounted to said vehicle;

a telescopic boom having a base;

a releasable means for pivotally coupling the base of the telescopic boom to said turntable when in a raising configuration and for releasing the base of the telescopic boom from the turntable when in a lateral movement configuration;

rollers mounted to the vehicle at positions so the telescopic boom may be moved longitudinally relative to the vehicle when the pivotally coupling means is in the lateral movement configuration;

a dual function main hydraulic ram including a piston and a cylinder, one of the piston and cylinder mounted to the vehicle; and a means for securing the other of the piston and cylinder to a plurality of positions along the telescopic boom to permit the hydraulic ram to move the telescopic boom along the rollers when the pivotal coupling means is in the lateral movement configuration and to permit the hydraulic ram to raise the telescopic boom about the pivotally coupling means when the pivotally coupling means is in the raising configuration.

2. The crane as recited in claim 1, wherein the vehicle includes a chassis to which the turntable is mounted.

3. The crane as recited in claim 1, wherein the securing means includes at least one engaging pin for coupling said hydraulic ram to a plurality of positions along the telescopic boom.

4. The crane as recited in claim 1, further comprising a hoist drum pivotally mounted to said releasable means for pivotally coupling said telescopic boom to said turntable.

5. The crane as recited in claim 1, wherein the releasable means for pivotally coupling the base of the telescopic boom to said turntable includes a superstructure frame.

6. The crane as recited in claim 1, wherein the vehicle is self-propelled.

7. The crane as recited in claim 6, further comprising a vehicle cab and a separate operator's cab.

8. The crane as recited in claim 1 wherein the cylinder is secured to the vehicle.

* * * * *